US007607540B2

(12) United States Patent
Ballard

(10) Patent No.: US 7,607,540 B2
(45) Date of Patent: Oct. 27, 2009

(54) PORTABLE FOOD STORAGE CONTAINER

(76) Inventor: Donna Ballard, 2358 Bay Meadows Cir., Pleasanton, CA (US) 94566-5437

( * ) Notice: Subject to any disclaimer, the term of this patent is extended or adjusted under 35 U.S.C. 154(b) by 202 days.

(21) Appl. No.: 11/858,772

(22) Filed: Sep. 20, 2007

(65) Prior Publication Data

US 2009/0078607 A1 Mar. 26, 2009

(51) Int. Cl.
*A45C 11/20* (2006.01)

(52) U.S. Cl. ..... 206/546; 206/547; 190/109

(58) Field of Classification Search ..... 206/541, 206/542, 543, 544, 545, 546, 547, 549, 576; 220/520, 528, 521, 522; 190/109, 110
See application file for complete search history.

(56) References Cited

U.S. PATENT DOCUMENTS 4,397,398 A * 8/1983 Watanabe ..... 220/7
4,420,678 A 12/1983 Kalb
4,771,907 A 9/1988 Torney
5,024,067 A 6/1991 Maier, II
5,082,115 A 1/1992 Hutcheson
5,501,338 A 3/1996 Preston
5,950,834 A 9/1999 Woodnorth
6,067,813 A 5/2000 Smith
6,296,488 B1 10/2001 Brenkus
6,994,131 B2 * 2/2006 Dedmon ..... 150/106
2006/0124503 A1 * 6/2006 Groberg et al. ..... 206/541
2006/0144750 A1 * 7/2006 Dziaba et al. ..... 206/549

* cited by examiner

*Primary Examiner*—Jacob K Ackun, Jr.
(74) *Attorney, Agent, or Firm*—John Nielsen; Randick O'Dea & Tooliatos, LLP

(57) ABSTRACT

The invention described herein comprises a food storage container that provides an insulated box member having a plurality of walls defining an internal cavity, and at least one wall being hinged or otherwise movable to enable access to the interior. The box is conditioned to carry a plurality of internal, modular storage bin members of various shapes and capacities.

17 Claims, 10 Drawing Sheets

PORTABLE FOOD STORAGE CONTAINER

BACKGROUND OF THE INVENTION

A. Field of the Invention

The invention broadly relates to portable food storage containers.

B. Background of the Invention

In the past few years, dieting trends and childhood obesity have shifted greater emphasis on portion control. More food manufacturers now offer products packaged for the health and diet-conscious consumer. However, few makers of personal thermal coolers, lunch totes and disposable food storage containers offer portioning alternatives for consumers wanting flexibility in preparing meals for work, school, travel and recreation. The invention described herein addresses the current limitations of storing and cooling healthier portioned food along with a beverage.

C. Prior Art

While there are many makers of plastic, disposable food storage containers, portable coolers, meal carriers, totes, and the like only a few specifically target the diet-conscious market.

Brenkus (U.S. Pat. No. 6,296,488) comprises a diet method which is designed to provide the user with a balanced diet while restricting the caloric intake by controlling the portion size in a simple and convenient manner. The method employs an apparatus which is preferably in the shape of a plate comprising a plurality of compartments which are designed to enclose a specified volume of food. The apparatus is used with associated meal cards having a variety of foods listed thereon. The foods are listed in specific sections on the card which correspond to the compartments of the apparatus.

Smith (U.S. Pat. No. 6,067,813) comprises a portable modular cooler system for beverages which includes one or more bottles containing a freezable coolant refrigerant. The bottles define recesses for receiving the housed beverage containers. An insulated casing extends about the bottle to maintain and contain containers in a cooled condition for an extended period of time. The bottles and casing are inserted into a carrying case for convenience of the user.

Torney (U.S. Pat. No. 4,771,907) comprises a food storage container that provides an insulated box member having a plurality of walls defining an internal cavity, and at least one wall being hinged or otherwise movable to enable access to the interior. The box is conditioned to carry a plurality of internal, modular storage bin members of various shapes and capacities. The storage bins include protruding edge portions that fit within integral side sleeves formed in the interior walls of the box to secure the storage bins in a particular position.

Woodnorth (U.S. Pat. No. 5,950,834) comprises a lunch holder for holding a food product and a beverage container includes a cover section and a base section. A base divider separates the base section into a food product compartment and a beverage container compartment including a container receiving area shaped to receive a generally cylindrical container. The beverage container compartment further includes a recessed portion disposed below the container receiving area for collecting condensation falling from the cylindrical beverage container and which is further shaped to receive a rectangular beverage container. The lunch holder also includes an inner lid which covers the food product compartment.

Kalb (U.S. Pat. No. 4,420,678) comprises a lunch bucket or box that includes an elongated three-sided container having an L-shaped top cover and a side wall door pivotally attached to the container walls to form a closed container. The container is compartmented with a series of food compartments exposed through the sidewall door, and at least one of which has a vertical divider to define beverage can compartments. The upper end of the container is constructed to releasably receive an integrated hot plate and bowl unit for heating of food products. The container is exposed by opening the top cover.

Hutcheson (U.S. Pat. No. 5,082,115) comprises a portable meal container that includes a base member for containing food having a substantially rectangular bottom wall and four integral perpendicular side walls of equal height terminating in a unitary top rim and a detachable cover member having top and bottom surfaces adapted to form a tight seal with the top rim portion of the base member. The meal container includes a thermally insulated container member for receiving and disbursing liquid releasably attached to a portion of the top surface of the cover member and a compartment member for containing at least one eating utensil within the compartment member which is also attached to a portion of the top surface of the cover member. The utensil compartment member includes a cover detachable sealed to the upper surface of the compartment member for providing access to the compartment member and the utensils contained therein.

Preston (U.S. Pat. No. 5,501,338) is a food carrier that comprises a plurality of stacked, interchangeable rigid food tray assemblies, at least one of the tray assemblies having a plurality of compartments formed therein. A strap secures the stacked food tray assemblies to each other, the strap comprises a handle for carrying the food carrier. A thermally insulated cover is provided for the outside of the food tray assemblies for stabilizing the temperature of the food contained therein.

Maier (U.S. Pat. No. 5,024,067) is a container with a freezable liquid for use in or out of an ice chest for temporary cooling purposes. The container generally has a top and a bottom and four sides connected to form a rectangular box type structure. The sides are to have dovetail joints that work as a fastening means to connect more than one together, thus making for a longer lasting cooling means. Maier is distinguishable from the invention described herein in a variety of ways, including that Maier is limited to the cooler element within a box, and that the invention described herein does not have dovetail joints, preferably has protrusions on the bottom of the cooler to stabilize it within the container, and is also used in combination with a folding plate and food containers.

These and other products market to health and diet-conscious consumers. Each product is unique in function and style, however, all have either limitations relating to interchangeability with different volume containers and/or flexibility in storing and cooling portioned food with a beverage. The invention described herein solves these deficiencies in the art and provide a novel and useful product.

BRIEF SUMMARY OF THE INVENTION

The invention comprises a compact portable food carrier with the following internal compartments a two-panel folding food plate and a beverage cooling chamber.

The benefit of the invention is that helps diet-conscious people have flexibility in preparing healthier meals for work, school, travel and recreation. Millions of Americans are faced with the challenge of eating healthier while being increasingly on-the-go. This invention offers a reasonable option.

The invention is preferably used as a vertical rectangle-shaped plastic container with rounded edges. Functionally, it is preferably made of a rigid plastic and includes a top and a base or tub. The top is hinged or otherwise attached to the base and opens from one side using a latch. In the center of the top is a shallow bowl which is recessed into the top. The bowl has a lid and handle. The handle on the lid twists onto and seals the bowl. The handle also is used to carry the entire unit.

The Base: The tub-like base holds all the inner compartments, including the two-panel folding plate and its modular compartments of different volumes and the Beverage Cooling Chamber. The internal compartments should be removed from the base before the use. The floor of the base has shallow recesses or indentations for the folding food tray and the Beverage Cooling Chamber to nest into. These features prevent noise from occurring during use.

Two-Panel Folding Plate: The plate and its modular food containers are preferably made of a dishwasher and microwave safe plastic. When stored inside the base, the plate folds to a 90° angle. The entire tray should be removed from the carrier and opened onto a flat surface in order to operate the modular containers. When opened, one of the flat surfaces includes a series of tracks. These tracks permit the container's flanged base to slide into the tracks on the plate and become secure.

Portion Food Containers: These units are modular, made of a dishwasher and microwave safe plastic. They include a top and a lid. The lid on each container can be made so it is leak resistant and/or airtight. However, the absence of either qualitative feature doesn't restrict the function of the containers from holding solid foods. The food containers are secured onto the folding plate and each compartment has a flange around its base. The flanged base allows each compartment to slide in and out of the tracks on the plate.

The Beverage Cooling Chamber (i.e. insulated beverage container): An important element in cooling the contents of the invention is the rectangle-shaped beverage cooling chamber. The unit is preferably made of a plastic and filled with a liquid refrigerant. After freezing the unit, it works very much like a block of ice in the center of the carrier. The cylindrical opening in the cooling chamber holds a beverage of preferably 18 oz or less. The bottom side of the chamber preferably has protrusions (preferably four) that extend out to snap into the floor of the carrier.

Also, it should be noted that the height of the carrier is primarily determined by the height of the beverage cooling chamber and the plate. Therefore, the carrier can be made smaller, which may be more commercially attractive in some markets, such as children's lunch boxes, if the height of the beverage cooler and the plate is made shorter.

OPERATION OF THE INVENTION

Prior to use, remove the Beverage Cooling Chamber and place it in a freezer for a minimum of 5 hours.

Begin use by opening the carrier and removing the Two-Panel Folding Plate. Open it on a flat surface.

Remove lids from the attached food containers and place food inside. If different volume containers are desired, slide the unused container out and insert another container into the track.

Reseal all of the lids and be sure each container is fully inserted into the tracks on the plate.

Fold the plate in half and place the plate back into the carrier. Use the recessed tracks on the floor to secure the plate in place.

Insert the Beverage Cooling Chamber into the center of the carrier using the recesses on the floor of the carrier. Next, place a beverage inside the hallow center.

Close the top and latch to secure all internal contents.

To store small items such as condiments or snack items, twist the lid off of the recessed bowl, insert items and twist lid back on when finished, and the invention described herein is ready to carry and use.

DETAILED DESCRIPTION OF THE INVENTION

Figure 1:
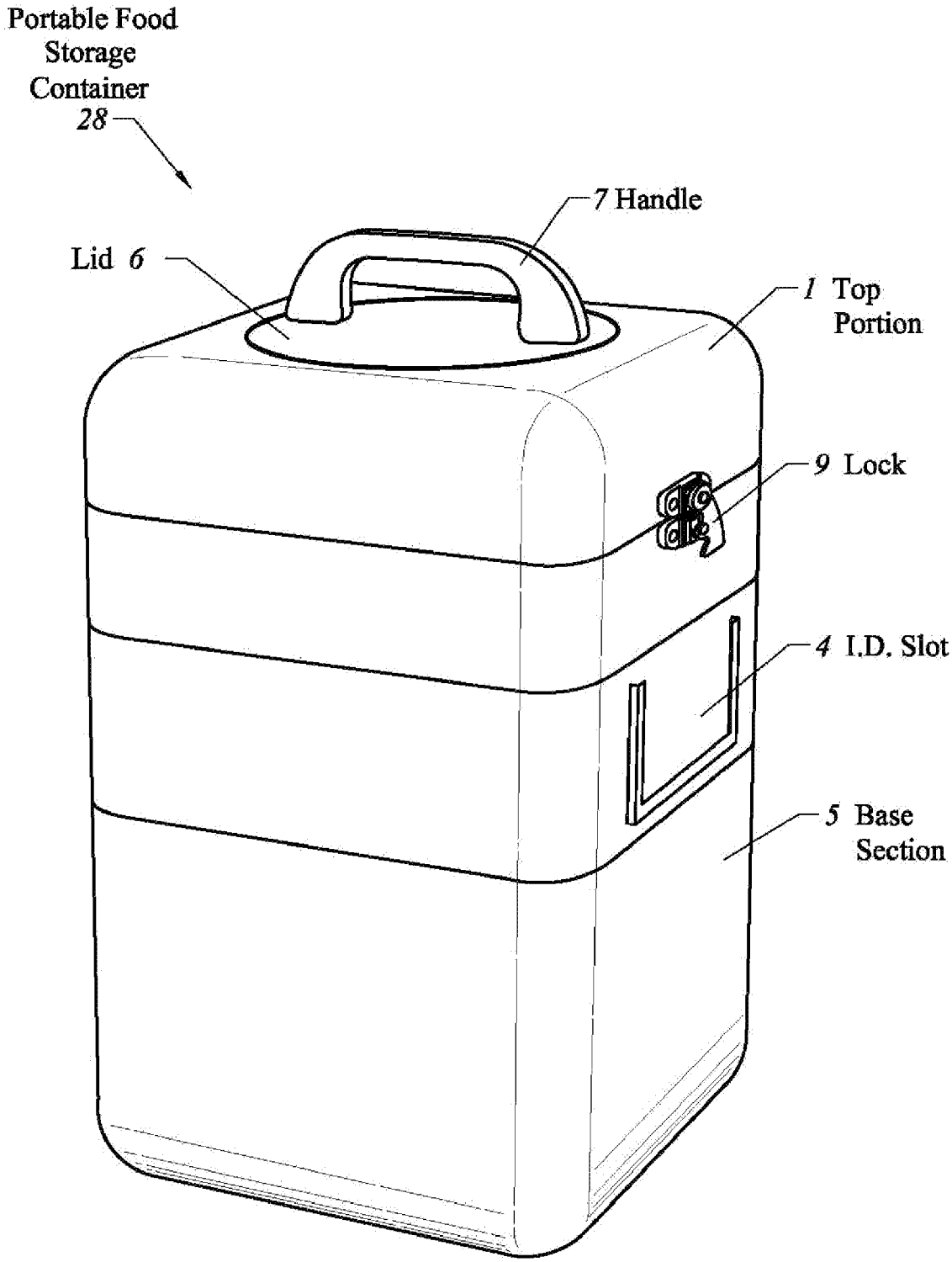
FIG. 1 is a perspective view of the portable food storage container.

FIG. 1 illustrates a perspective view of an embodiment of the invention. This drawing shows the invention assembled and closed. The handle 7 and lid 6 are shown atop the portable food storage container 28, wherein the top portion 1 is hinged on the side (not shown), and locked onto the base section 5 with the lock 9. An identification card can be placed in the identifier slot 4 on the base 5. The portable food storage container 28 comprises a box member having top, bottom, right, left, back and front wall portions defining an interior space, each of said wall portions having an inside and an outside surface, and said top wall portion providing a door being connected to the box member to enable access to said interior space. The portable food storage container 28 can be lifted and carried via the handle 7 while the handle 7 is attached to the portable food storage container 28 (e.g. while the lid 6 is screwed into the recessed bowl 18).

Figure 2:
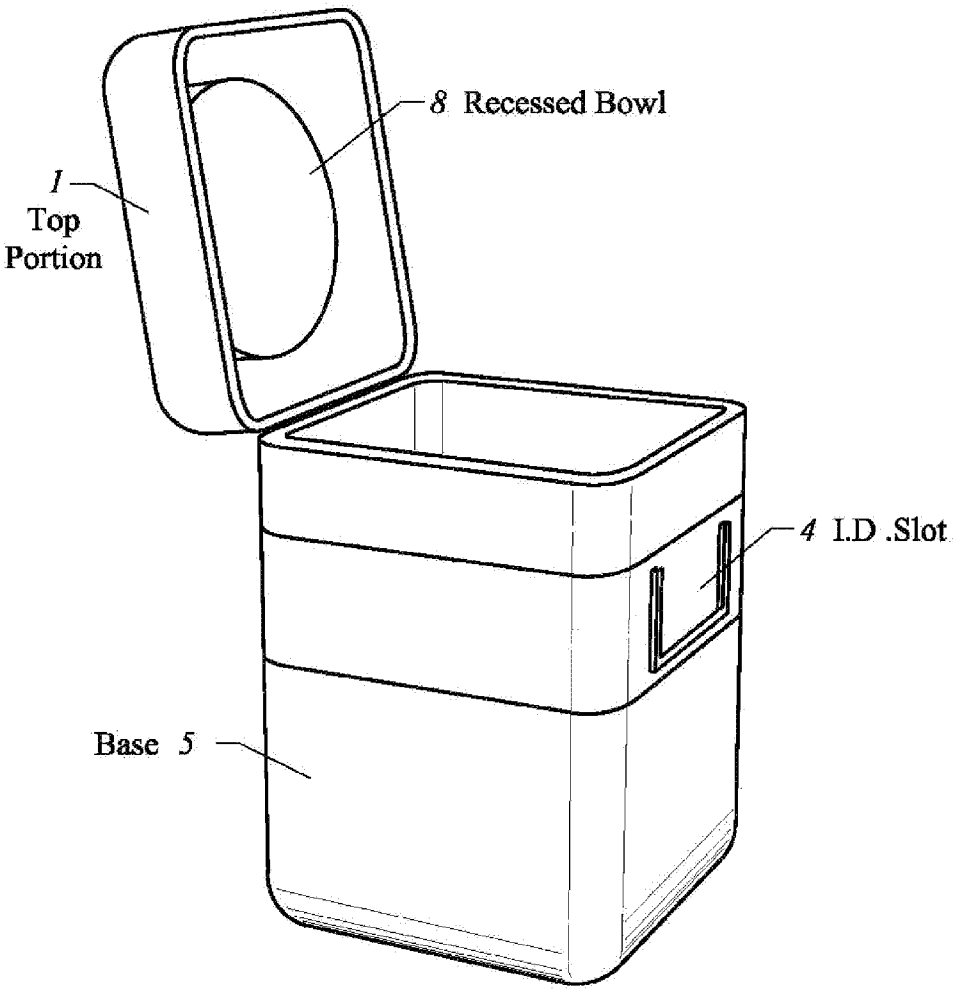
FIG. 2 is a perspective view of the portable food storage container with the top portion in the open position.

FIG. 2 shows the invention with the top portion 1 opened and attached to the base section 5 via a hinge 10. The identifier slot 4 can receive and hold a card or other identifier. The card or other identifier can be inserted into the identifier slot 4 to show information relating to the owner, such as a name, phone number, or even the contents of the container. Attached to the top portion 1, is the recessed bowl 8. The recessed bowl 8 is accessible by removing the lid 6 from the top portion 1. The bottom section 5 of the carrier holds the folding food plate, beverage cooler 15, utensils, etc.

Figure 3:
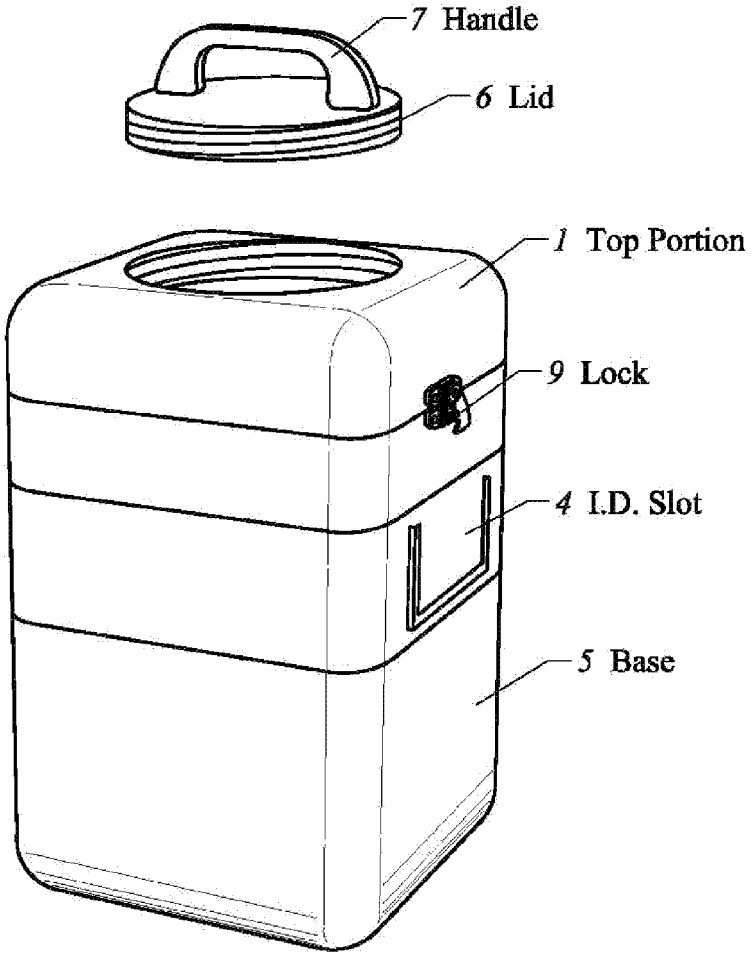
FIG. 3 is a perspective view of the portable food storage container with the lid separated from the top portion.

FIG. 3 is a perspective view of the portable food storage container with the lid 6 separated from the top portion 1. The grooves on the lid 6 allow the user to twist the lid 6 into the recessed bowl 8 that is attached to the top portion 1. The handle 7 is used to hold the carrier 28 and twist or otherwise affix the lid 6 into the recessed bowl 8. Also shown in FIG. 3 is the locking mechanism 9, such as a latch, that attaches the top portion 1 to the base portion 5. The identification slot 4 will preferably comprise a three sided slot that allows a card or other identifier to be slid into the slot.

Figure 4:
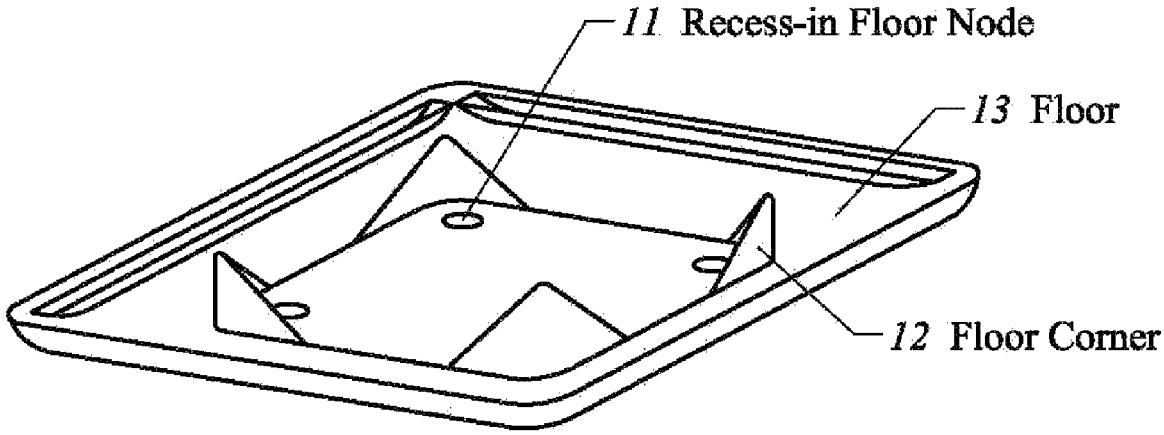
FIG. 4 is a perspective view of the floor of the portable food storage container.

FIG. 4 shows is a perspective view of the floor 13 of the portable food storage container 28. The floor 13 is generally located on the bottom of the interior of the carrier, and supports the beverage cooling chamber. The floor 13 will preferably include recesses 11 of a size and shape to accommodate the protrusions on the bottom of the cooling chamber. The primary purpose for the recesses 11 and protrusions is to help stabilize the beverage cooling chamber while it is in the carrier.

Also shown in FIG. 4 are the floor corners 12. These raised sections of the floor, or brace members, are meant to further stabilize the cooling chamber 15 while it is in the carrier 28. There are preferably four brace members 12, as shown, and they are preferably sized and shaped so as to snugly accommodate the cooling chamber 15.

Figure 5:
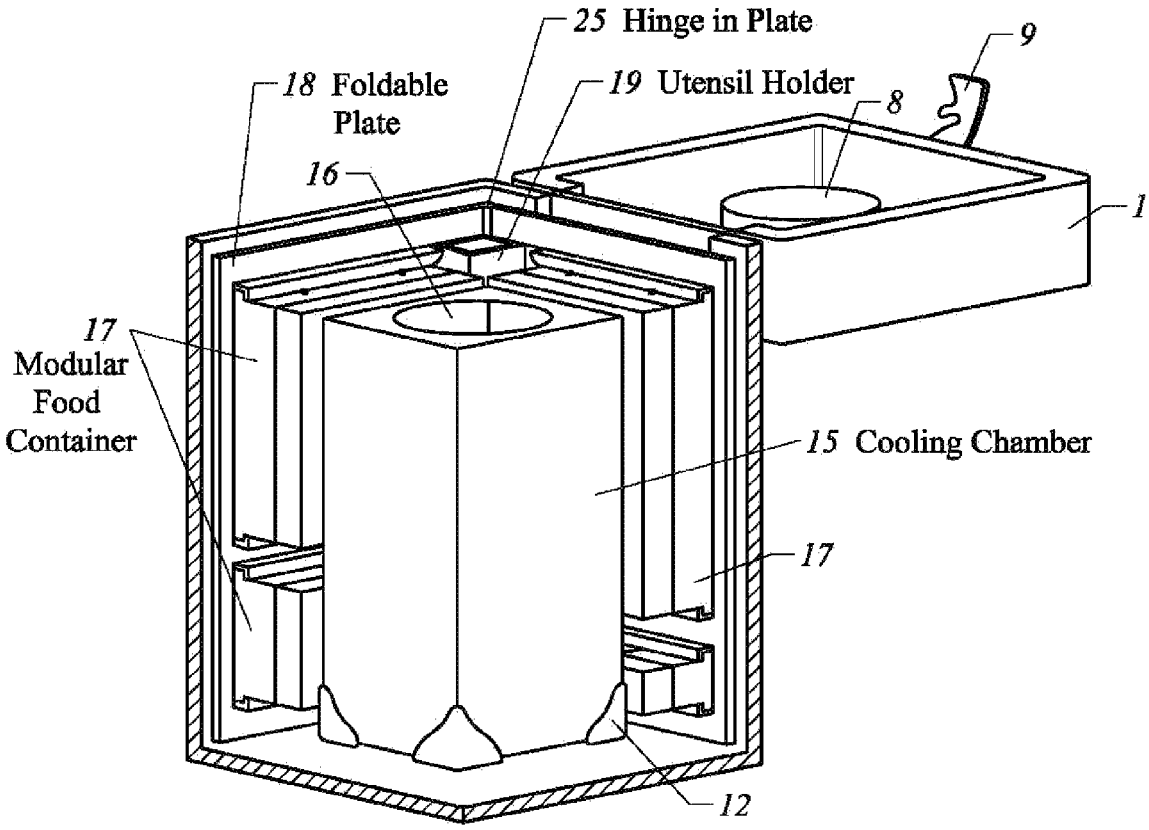
FIG. 5 is a cross section view of the portable food storage container with the top portion in the open position.

FIG. 5 is a cross section view of the portable food storage container 28 with the top portion 1 in the open position. The lock 9, and recessed bowl 8 are shown attached to the top portion 1. The cooling chamber 15 is shown upright and secured to the floor 13, and comprises a cylindrically shaped interior space capable of holding a beverage container, a plurality of exterior surfaces, including a top, bottom, and four sides. The cooling chamber 15 preferably comprises a cylinder shaped interior compartment 16 capable of holding a generally cylinder shaped beverage container, such as a water bottle, soft drink container, etc. The brace members 12 are shown supporting and securing the bottom of the cooling chamber 15. The cooling chamber 15 preferably has generally rectangular sides.

FIG. 5 also shows modular food containers 17 attached to the foldable plate 18. The modular food containers 17 comprise an interior space capable of holding comestible products, a lid 20, and a flanged base 22. Multiple modular food containers 17 can be attached to the foldable plate 18, and can vary in size. A utensil holder 19, is shown attached to the plate near the hinge 25 in the foldable plate 18. The utensil holder 19 can further comprise a sliding section to assist the user in placing utensils in, or removing them from, the utensil holder 19. The hinge 25 in the plate 18 allows the plate 18 to be folded into two substantially planar sections at an approximate 90 degree angle such that the bottom side of each section is capable of abutting two adjoining interior wall portions of the box member when the plate 18 is folded.

Figure 6:
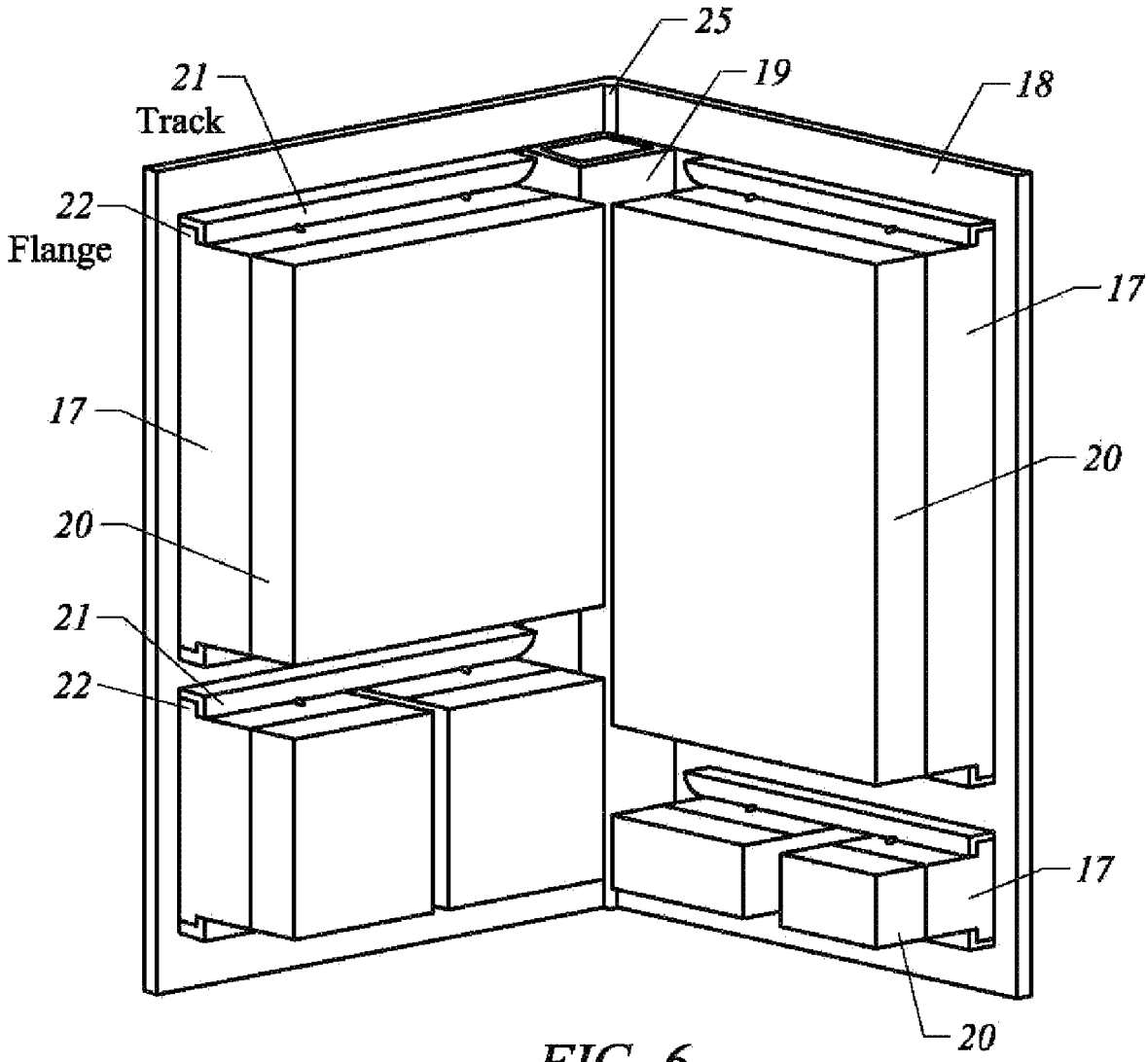
FIG. 6 shows a perspective view of the plate (folded), and the attached food containers.

FIG. 6 shows a perspective view of the foldable plate 18, in its folded position. The foldable plate 18 comprise a plurality of tracks 21 on the top side of the plate 18 capable of accepting the flanged bases 22 of the modular food containers 17, wherein said tracks 21 are capable of sliding engagement with the flanges 22 of the modular food containers 17. Attached to the foldable plate 18 are the modular food containers 17, that comprise flanges 22 at the base. Also shown are container tracks 21 on, or attached to, the foldable plate 18. The combination of these flanges 22 and the container tracks 21 allow the modular food containers 17 to slide onto, and off of, the foldable plate 18. The location of the container tracks 21 may be adjustable on the plate 18 to accommodate different sizes of modular food containers 17.

The modular food containers 17 also comprise lids 20. The primary purpose for the lids 20 on the modular food containers 17 is to secure and protect the food contained therein. The lids 20 may attach to the modular food containers 17 in a variety of ways, however they will preferably snap on through friction. Also shown is the utensil box 19, again shown near the hinge 25 of the foldable plate 18. The utensil box 19 is a long rectangle shaped box with a sliding lid. The lid to the utensil box 19 can be removed by sliding it along one side, thereby exposing stored utensils such as a knife, folk, spoon and/or straw. Preferably, this utensil box 19 is permanently attached to the plate 18.

Figure 7:
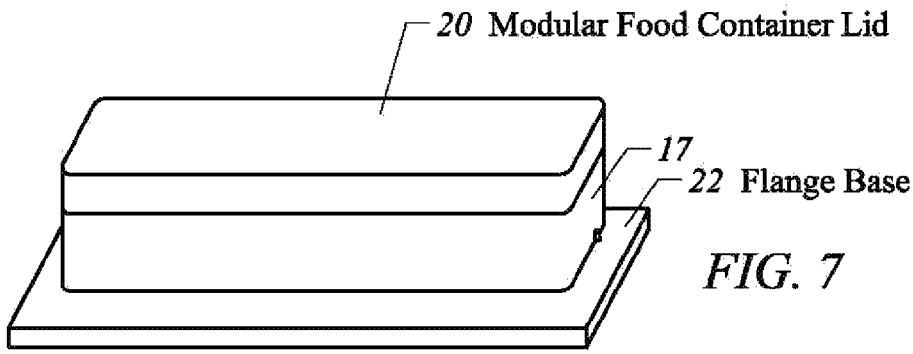
FIG. 7 shows an isolated perspective view of the a modular food container, along with its lid, and flange base.

FIG. 7 shows an isolated perspective view of the a modular food container 17, along with its lid 20, and flange base 22. The lid 20 is shown attached to the modular food container 17.

Figure 8:
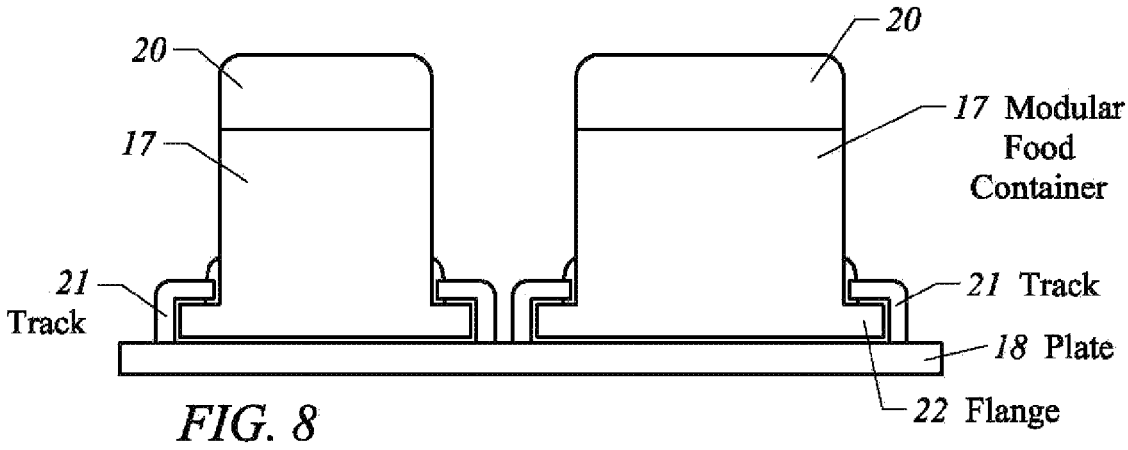
FIG. 8 shows an isolated side view of the two modular food containers, lids, and flanged bases, plate, and tracks.

FIG. 8 shows an isolated side view of the two modular food containers 17, lids 20, flanged bases 22, plate 18, and tracks 21. The flanged bases 22 and the container tracks 21 on the plate, are sized so as to allow the modular food containers to slide under the tracks 21 to secure them to the plate 18.

Figure 9:
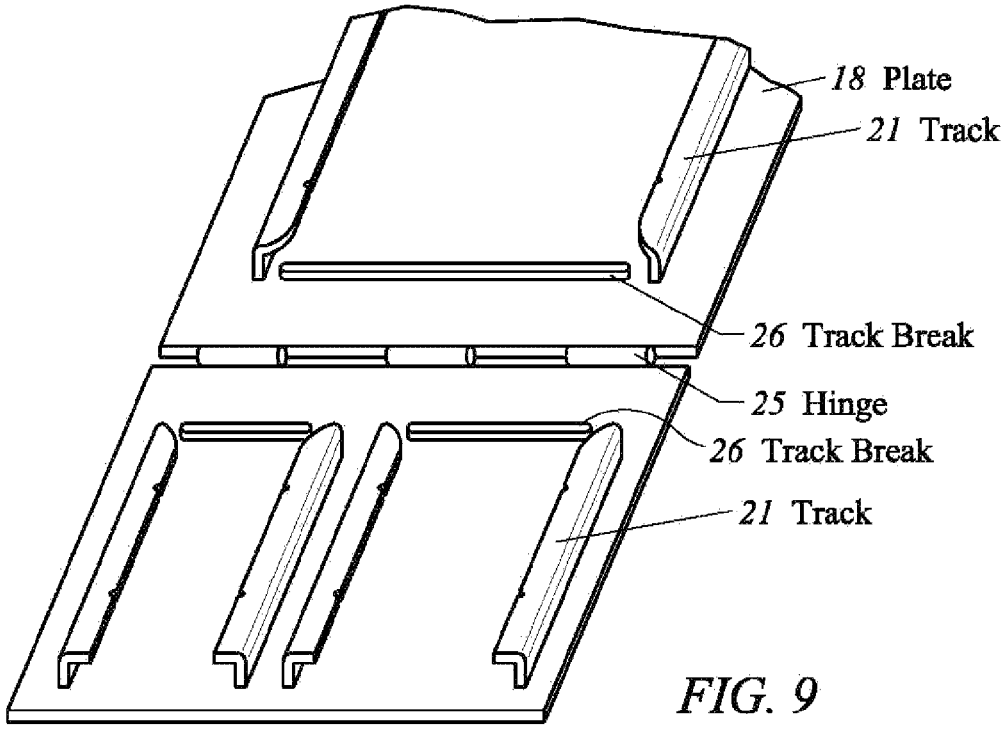
FIG. 9 shows a perspective view of the top of the foldable plate and its container tracks.

FIG. 9 shows a perspective view of the top of the foldable plate 18 and its container tracks 21. Each set of container tracks 21 are shown generally parallel to each other so as to allow the modular food containers 17 and flange base 22 to slide into place. The hinge 25 of the foldable plate 18 is shown, as well as track breaks 26, which are located on the plate 18 and limit the distance the modular food containers 17 can be slid along the container tracks 21. The form of the track breaks can vary, but are shown in this figure to be a length of protrusion on the plate 18, generally perpendicular to the container tracks 21.

Figure 10:
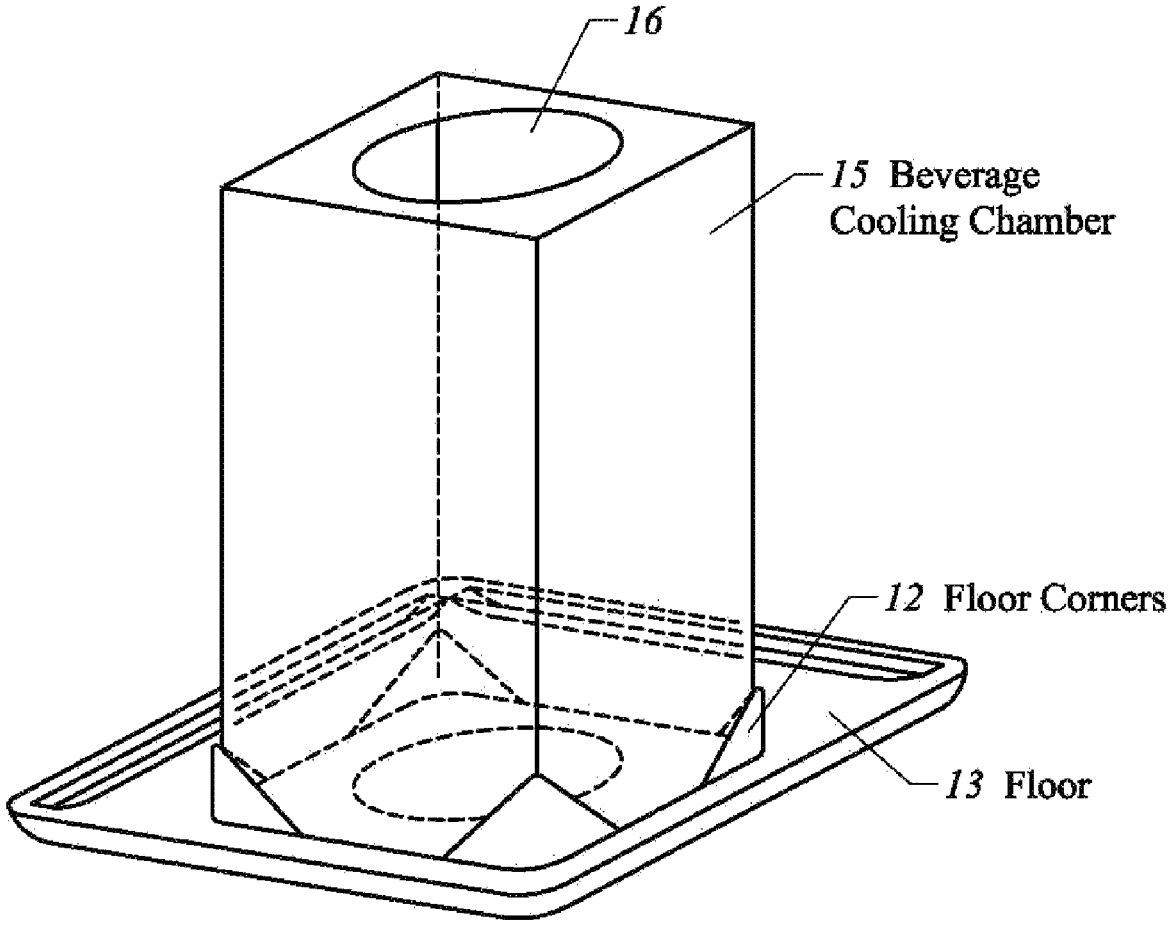
FIG. 10 shows a semi transparent perspective view of the beverage cooling chamber nested into the floor of the carrier.

FIG. 10 shows a semi transparent perspective view of the beverage cooling chamber 15 nested into the floor 13 of the carrier. As discussed above, the cooling chamber 15 preferably comprises a cylinder shaped interior compartment 16 capable of holding a generally cylinder shaped beverage container, such as a water bottle, soft drink container, etc. The brace members 12 are shown supporting and securing the bottom of the cooling chamber 15. The cooling chamber 15 preferably has generally rectangular sides.

Figure 11:
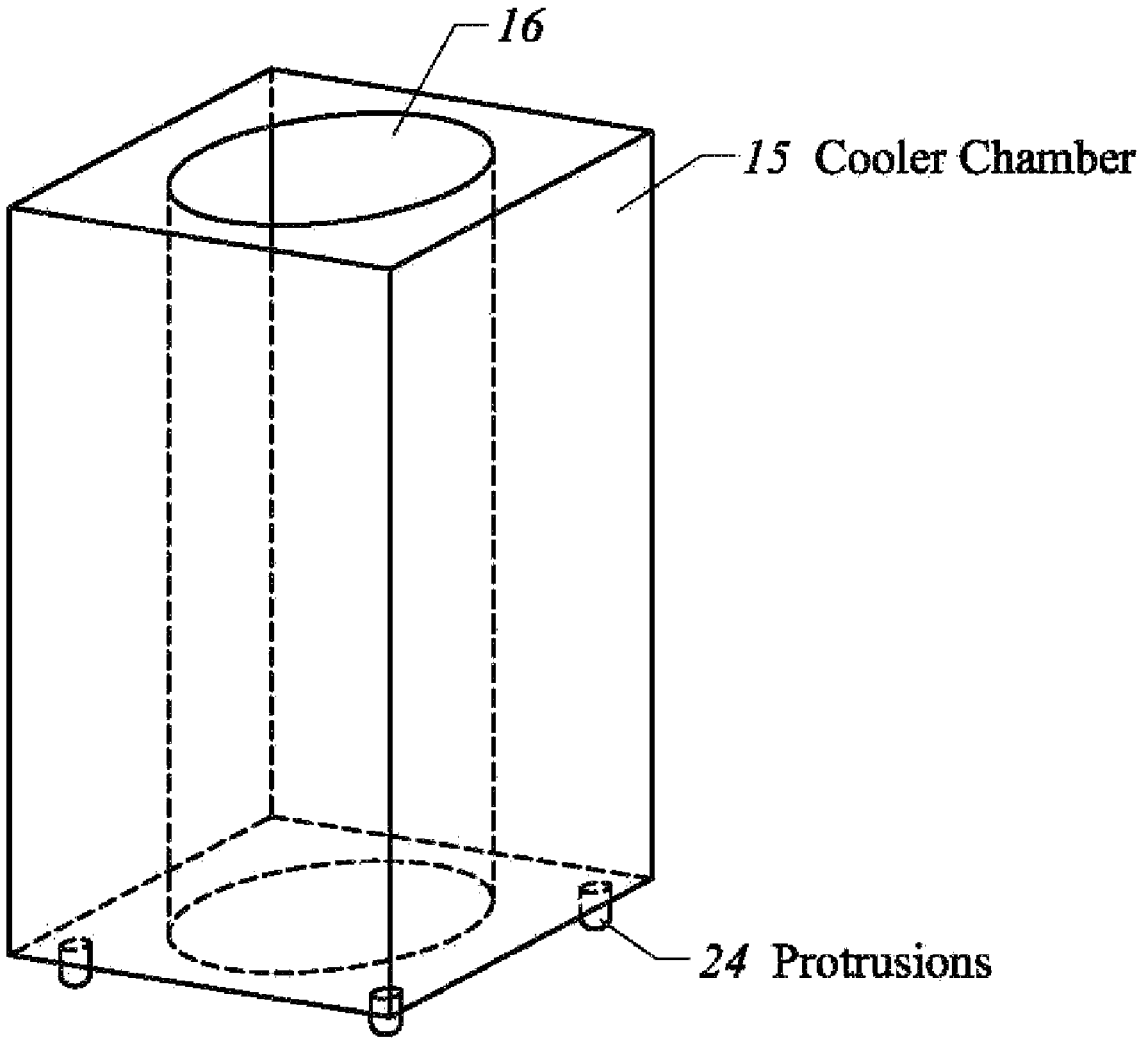
FIG. 11 shows a semi transparent perspective view of the beverage cooling chamber.

FIG. 11 shows a semi transparent perspective view of the beverage cooling chamber 15. Protrusions 24 are shown located on the bottom of the cooling chamber 15. These protrusions 24, when the beverage cooling chamber 15 is nested into the floor 13 of the carrier, are inserted into the recesses 11 of the floor 13 to add stability. See FIG. 4. There are preferably four protrusions 24 located on the bottom of the cooling chamber 15.

Figure 12:
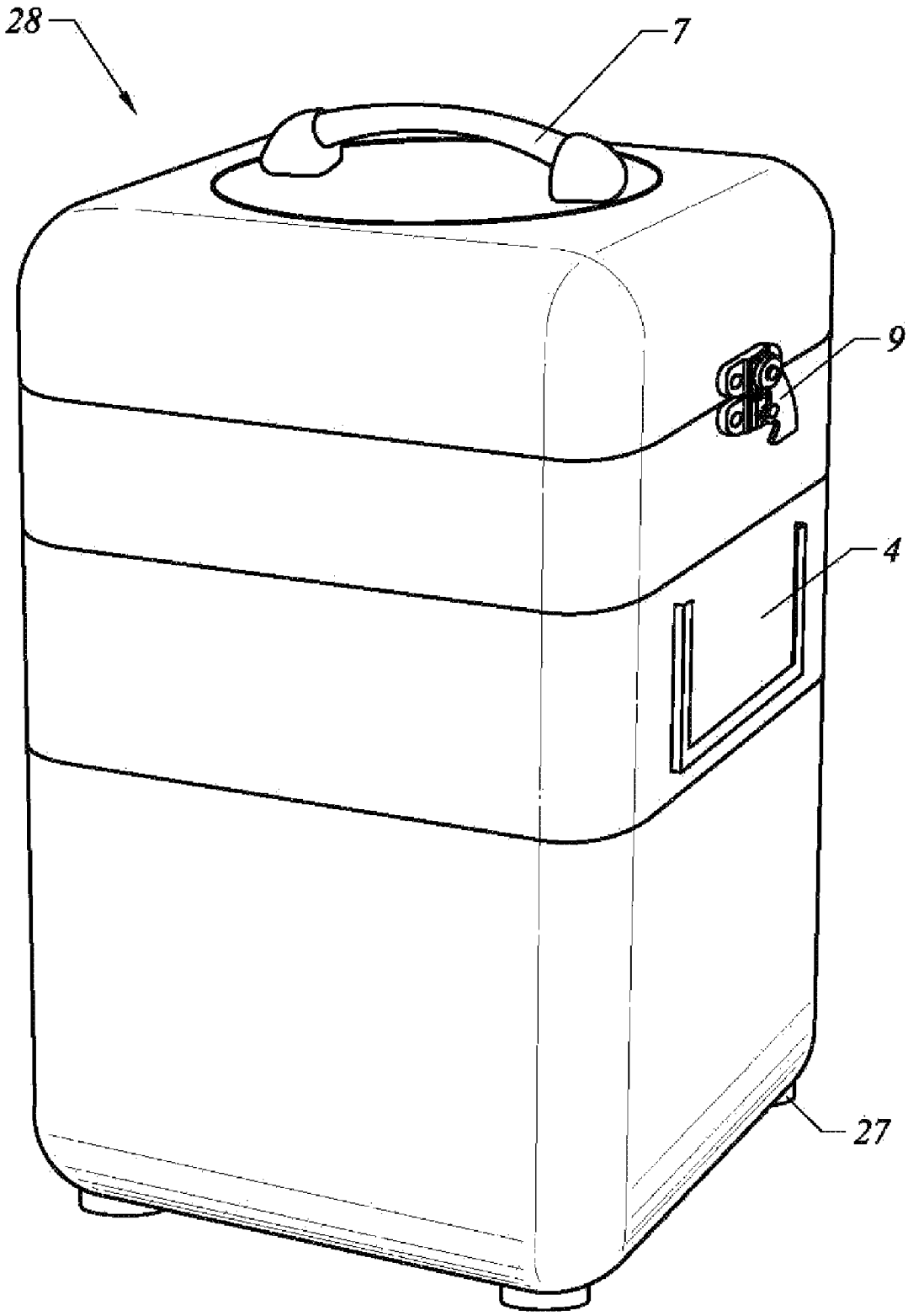
FIG. 12 is a perspective view of the portable food storage container.

FIG. 12 is a perspective view of the portable food storage carrier 28. Shown here is a different style of handle 7, as well as carrier feet 27. There are preferably four of these carrier feet 27 protruding from the bottom of the carrier 28, and improve the appearance, and the function, of the carrier.

Figure 13:
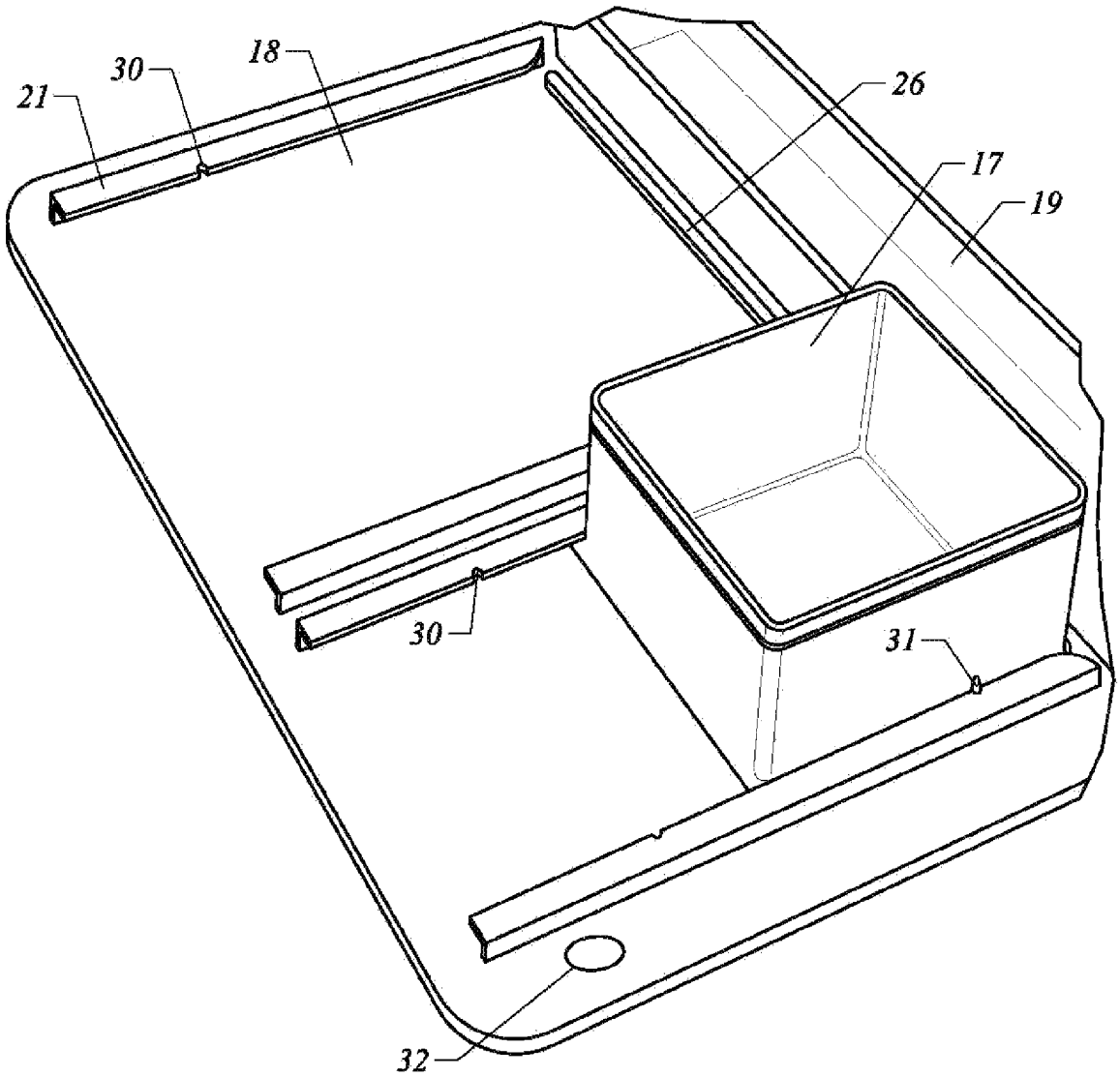
FIG. 13 shows a perspective view of the top of the foldable plate and its container tracks, as well as an open modular food container and utensil holder.

FIG. 13 shows a perspective view of the top of the foldable plate 18 and its container tracks 21, as well as an open modular food container 17. The modular food container 17 is shown with small protrusions 31 on their sides. FIG. 13 also shows small notches or indentations 30 in the tracks 21. The purpose of these protrusions 31 and grooves 30 is to allow the modular food container 17 to lock into place along the tracks 21 at the locations along the track where the protrusions and grooves come into alignment. Also, the utensil holder 19 is shown with no lid. Preferably, the lid to the utensil holder 19 can be slid on or off along the top of the utensil holder 19 to open and close it. Lastly, in order to more easily grasp the plate 18, a dimple 32, such as a round indentation along an edge of the plate 18, could be included.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. A food and beverage storage container comprising:

a. a box member having top, bottom, right, left, back and front wall portions defining an interior space, each of said wall portions having an inside and an outside surface, and said top wall portion providing a door being connected to the box member to enable access to said interior space;

b. a plurality of modular food containers, each comprising:

i. an interior space capable of holding comestible products;

ii. a lid; and iii. a flanged base;

c. an insulated beverage container comprising:

i. a cylindrically shaped interior space capable of holding a beverage container; and ii. a plurality of exterior surfaces, including a top, bottom, and four sides; and d. a foldable plate having a top side and a bottom side comprising:

i. a plurality of tracks on the top side of the plate capable of accepting the flanged bases of the modular food containers, wherein said tracks are capable of sliding engagement with the flanges of the modular food containers; and ii. a hinge that allows the plate to be folded into two substantially planar sections at an approximate 90 degree angle such that the bottom side of each section is capable of abutting two adjoining interior wall portions of the box member when said plate is folded.

2. The food and beverage storage container of claim 1, further comprising:

a. an enclosed utensil holder attached to the top side of the plate.

3. The food and beverage storage container of claim 1, further comprising:

a. a plurality of protrusions on the exterior of the bottom surface of the box member.

4. The food and beverage storage container of claim 1, further comprising:

a. a plurality of brace members on the interior of the bottom side of the box member.

5. The food and beverage storage container of claim 1 further comprising a plurality of recesses on the interior of the bottom side of the box member.

6. The food and beverage storage container of claim 1, further comprising a bowl having a top side and an underside, wherein the inside surface of said top wall portion comprises the underside of the bowl.

7. The food and beverage storage container of claim 6, further comprising a lid having a top side and a bottom side wherein the lid is attachable to the top side of the bowl.

8. The food and beverage storage container of claim 7, wherein a handle member is attached to the top side of the lid.

9. The food and beverage storage container of claim 1, further comprising a locking means between the top wall portion and a side wall portion.

10. The food and beverage storage container of claim 9, wherein the locking means comprises a latch mechanism attached to the top wall portion and a side wall portion.

11. The food and beverage storage container of claim 9, wherein said top wall portion is connectable to and removable from at least two of said other wall portions, and is securable to said box member by a latch mechanism.

12. The food and beverage storage container of claim 1, further comprising a slot located on an outside surface of the container capable of holding a card.

13. The food and beverage storage container of claim 1, further comprising a plurality of protrusions located on the bottom of the exterior surface of the insulated beverage container.

14. The food and beverage storage container of claim 1, further comprising a utensil holder means located on the foldable plate.

15. The food and beverage storage container of claim 1, wherein the tracks on the top side of the plate comprise a plurality of indentations.

16. The food and beverage storage container of claim 1, wherein the modular food containers further comprise protrusions on at least two sides.

17. The food and beverage storage container of claim 1, wherein the container is made of plastic.

* * * * *